US005092398A

United States Patent [19]

Nishishita et al.

[11] Patent Number: 5,092,398

[45] Date of Patent: Mar. 3, 1992

[54] AUTOMOTIVE PARALLEL FLOW TYPE HEAT EXCHANGER

[75] Inventors: Kunihiko Nishishita; Takashi Sugita, Saitama, both of Japan

[73] Assignee: Zexel Corporation, Saitama, Japan

[21] Appl. No.: 709,102

[22] Filed: May 24, 1991

Related U.S. Application Data

[63] Continuation-in-part of Ser. No. 481,933, Feb. 16, 1990, Pat. No. 5,036,914.

[51] Int. Cl.[5] ..... F28D 1/053

[52] U.S. Cl. ..... 165/153; 165/173; 228/183

[58] Field of Search ..... 165/153, 173; 228/166, 228/183; 29/890.043

[56] References Cited

U.S. PATENT DOCUMENTS

| | | | |
|---|---|---|---|
| 1,795,055 | 5/1931 | Taylor et al. | 165/153 X |
| 3,866,675 | 2/1975 | Bardon et al. | 165/173 |
| 4,159,034 | 6/1979 | Bellovary et al. | 165/153 |
| 4,509,672 | 4/1985 | Woodhull, Jr. et al. | 228/175 |
| 4,759,405 | 7/1988 | Metzger | 165/173 |
| 4,945,635 | 8/1990 | Nobusue et al. | 29/890.043 |

FOREIGN PATENT DOCUMENTS

| | | | |
|---|---|---|---|
| WO84/1208 | 3/1984 | PCT Int'l Appl. | 165/153 |
| 944094 | 12/1963 | United Kingdom | 29/890.052 |
| 2082312A | 3/1982 | United Kingdom | 165/173 |

*Primary Examiner*—Allen J. Flanigan
*Attorney, Agent, or Firm*—Kanesaka & Takeuchi

[57] ABSTRACT

A condenser for use in an automobile air conditioner, which includes a pair of header pipes (1) each consisting of a tank portion (2) and an end plate (3); a plurality of parallel flat tubes (14) extending between the header pipes for supporting coolant flows; the end plate being continuously outwardly curved and joined to the tank portion such that inside surfaces of opposite joint edges (2*a*) of the tank portion overlap outside surfaces of opposite joint edges (3*a*) of the end plate, whereby the tank portion reinforces the end plate to withstand high pressures of the coolant flows. The flat tubes are brazed to the header pipes such that opposite ends of each flat tube are brought so closely to the joint edges that there is only a minimum clearance that is able to prevent brazing material from entering the flat tube, whereby the tank portion is minimized.

3 Claims, 4 Drawing Sheets

AUTOMOTIVE PARALLEL FLOW TYPE HEAT EXCHANGER

CROSS-REFERENCE TO RELATED APPLICATIONS

This is a continuation-in-part application of Ser. No. 481,933 filed Feb. 16, 1990, now U.S. Pat. No. 5,036,914.

BACKGROUND OF THE INVENTION

1. Field of the Invention

The present invention relates to automotive heat exchangers having inlet and outlet header pipes and a number of parallel tubes extending between the inlet and outlet header pipes to provide parallel flows of coolant between both of the header pipes.

2. Description of the Prior Art

The well-known parallel flow type heat exchangers, such as condensers for automotive air conditioners, include inlet and outlet header pipes and a number of flat tubes extending in parallel between the two header pipes.

In such heat exchangers, the flat tubes are connected to the header pipes by, as FIG. 7 shows, inserting each tube 23 into an insertion opening 22 of a header pipe 21 which has a circular cross-section (see Japanese Patent Application Kokai No 63-34466) or, as FIG. 8 shows, inserting each tube 28 into an insertion opening 27 of an end plate 26 which is joined to a tank portion 25 to form a header pipe 24 (see Japanese Patent Application Kokai No. 63-105400). With such heat exchangers, heat exchange is made by parallel flows of coolant passing through the flat tubes between the inlet and outlet header pipes.

However, in the arrangement of FIG. 7, it is difficult and time-consuming to form insertion openings on the curved wall of the header pipes for inserting flat tubes, resulting in high unit manufacturing costs.

In the arrangement of FIG. 8, although the two-component structure of the header pipes facilitates the formation of insertion openings on the end plate, this arrangement has a low resistance to the coolant pressure of the junction between the end plate and the tank portion, and the flat end plate must be tightly joined to the outer surface of the tank portion.

In addition, the brazing material tends to flow into the flat tubes, plugging some tubes. There is a demand for a compact condenser for automobile air conditioners.

SUMMARY OF THE INVENTION

Accordingly, it is an object of the invention to provide a compact automotive heat exchanger which is easy to assemble.

According to the invention, there is provided a condenser for use in an automobile air conditioner, which includes a pair of header pipes each consisting of a tank portion and an end plate; a plurality of parallel flat tubes extending between the header pipes for supporting coolant flows; the end plate being continuously outwardly curved and joined to the tank portion such that inside surfaces of opposite joint edges of the tank portion overlap outside surfaces of opposite joint edges of the end plate, whereby the tank portion reinforces the end plate to withstand high pressures of the coolant flows; and the flat tubes being brazed to the header pipes such that opposite ends of each flat tube are brought so closely to the joint edges that there is only a minimum clearance that is able to prevent brazing material from entering the flat tube, whereby the tank portion is minimized.

The above and other objects, features, and advantages of the invention will be more apparent from the following description when taken in conjunction with the accompanying drawings.

DESCRIPTION OF THE PREFERRED EMBODIMENT

Figure 1:
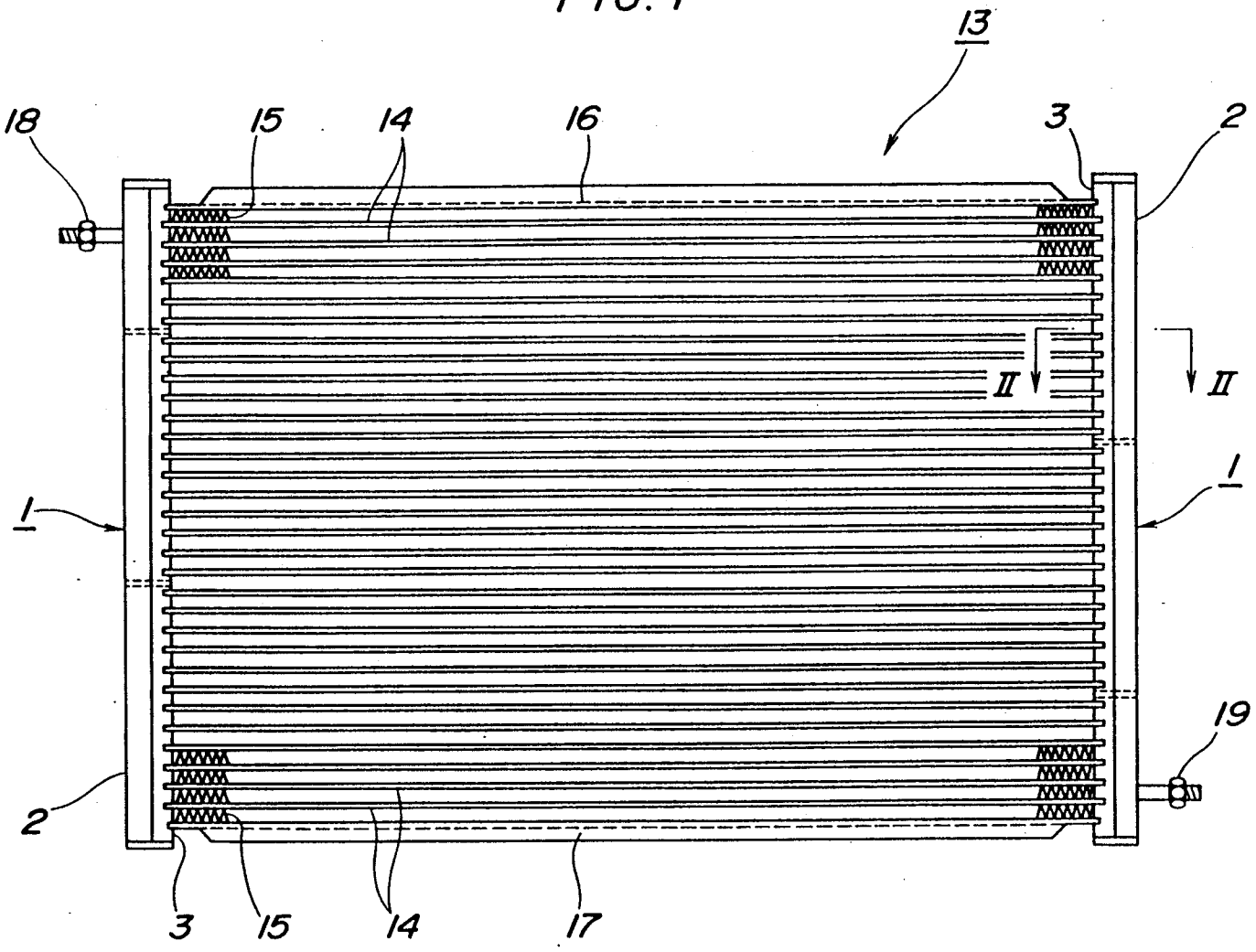
FIG. 1 is a front elevational view of a heat exchanger according to an embodiment of the invention.

In FIG. 1, a heat exchanger 13, such as an automotive condenser, includes an inlet header pipe 1, an outlet header pipe 1, and a number of flat tubes 14 extending in parallel between the inlet and outlet header pipes 1. Corrugated fins 15 are disposed between the flat tubes 14. Each flat tube 14 is inserted into and tightly joined to the inlet and outlet header pipes 1 at opposite ends through the insertion openings to form parallel flows of coolant through the flat tubes 14 between the inlet and outlet header pipes 1. The inlet and outlet header pipes 1 are provided with an inlet joint 18 and an outlet joint 19, respectively. The heat exchanger 13 is provided a pair of side plates 16 and 17.

Figure 2:
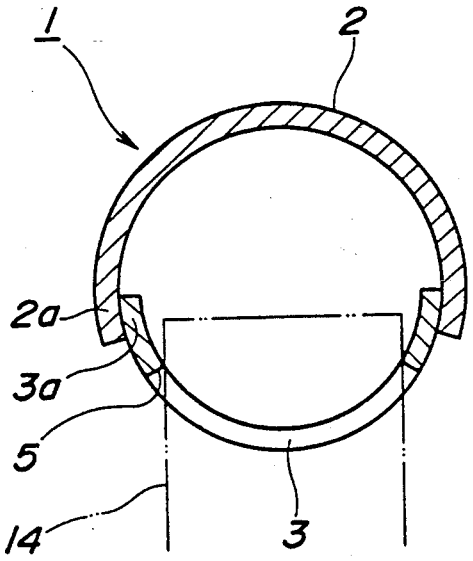
FIG. 2 is a cross sectional view taken along the line II—II of FIG. 1.

As FIG. 2 shows, each header pipe 1 has a substantially circular cross-section and consists of a tank portion 2 having a substantially semi-circular cross-section and an end plate 3 having a substantially semi-circular cross-section. The joint edges 3*a* of the end plate 3 are joined by brazing to the joint edges 2*a* of the tank portion 2 such that the outside surfaces of the joint edges 3*a* overlap on the inside surfaces of the joint edges 2*a*. To facilitate such joining, the radius of curvature of the end plate 3 is made slightly smaller than that of the tank portion 2. A number of openings 5 are formed by stamping in the end plate 3 for insertion of the flat tubes 14.

The flat tubes are joined to the header pipes such that the opposite ends of each flat tube are brought so closely to the joint edges that there is only a minimum clearance that is able to prevent the brazing material from entering the flat tube.

Since the end plate has a convex cross-section and since the joint edges overlap on the inside surfaces of the joint edges of the tank portion, the resistance of the header pipe to the coolant pressure is increased. The header pipe has a two-component structure so that it is easy to form openings on the end plate although it has a curved cross-section.

Since the ends of the flat tubes are brought so closely to the joint edges, it is possible to minimize the tank size.

In addition, there is a minimum clearance between the joint edges 2*a* and 3*a* and the ends of flat tubes so that no brazing material flows into the flat tubes, thereby preventing not only plugging of the flat tubes by the brazing material but also poor brazing because of a lack of the brazing material.

Figure 3:
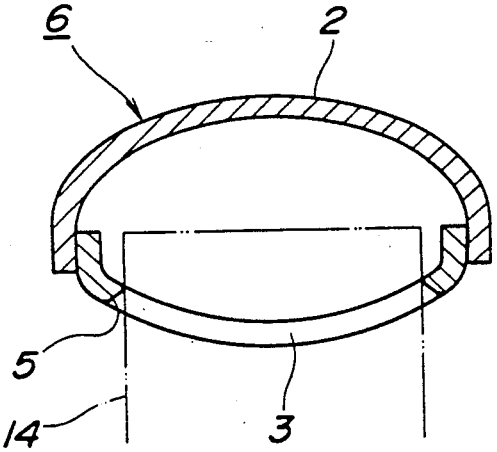
FIG. 3 is a cross sectional view of a header pipe according to another embodiment of the invention.

In FIG. 3, a tank portion 2 and an end plate 3 are formed and joined together so as to provide a header pipe 6 which has an elliptical cross section. As a result, not only the same results as those of the above embodiment are obtained but also the inside volume of the header pipe is reduced so that the volume of coolant is reduced.

The flat tubes are joined to the header pipes such that the opposite ends of each flat tube are brought so closely to the joint edges that there is only a minimum clearance that is able to prevent brazing material from entering the flat tube.

Since the ends of the flat tubes are brought so closely to the joint edges, it is possible to minimize the tank size. In addition, there is a minimum clearance between the joint edges 2*a* and 3*a* and the ends of flat tubes so that no brazing material flows into the flat tubes by the brazing material but also poor brazing because of a lack of the brazing material.

Figure 4:
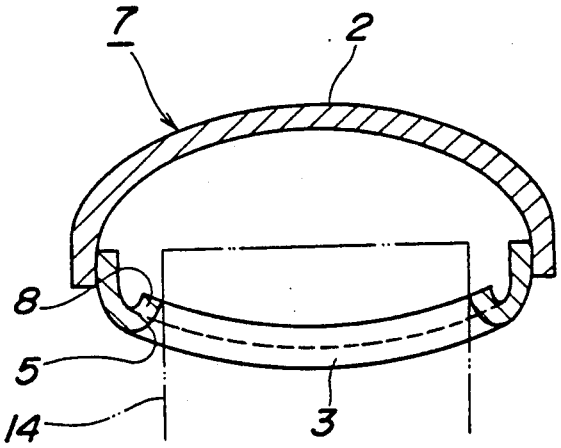
FIG. 4 is a cross sectional view of a header pipe according to still another embodiment of the invention.

In FIG. 4, similar to the FIG. 3 embodiment, a tank portion 2 and an end plate 3 are formed and joined together so as to provide a header pipe 7 having a substantially elliptical cross section. The peripheral edge of each opening 5, however, is bent inwardly to form a burr or flange 8. These burrs 8 are formed simultaneously with the insertion openings 5.

In this structure, the burrs 8 facilitate and assure the insertion of flat tubes 14 into the insertion openings 5, thus improving the productivity and reliability.

The flat tubes are joined to the header pipes such that the opposite ends of each flat tube are brought so closely to the joint edges that there is only a minimum clearance that is able to prevent the brazing material from entering the flat tube.

Since the ends of the flat tubes are brought so closely to the joint edges, it is possible to minimize the tank size. In addition, there is a minimum clearance between the joint edges 2*a* and 3*a* and the ends of flat tubes so that no brazing material flows into the flat tubes by the brazing material but also poor brazing because of a lack of the brazing material.

Figure 5:
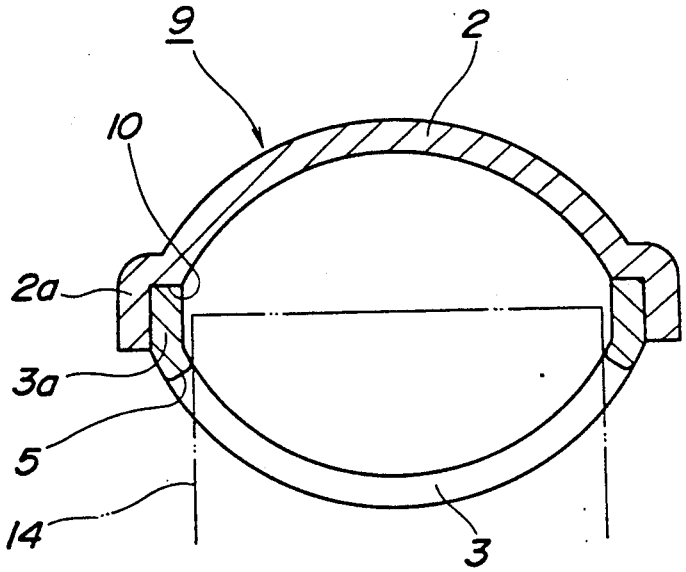
FIG. 5 is a cross sectional view of a header pipe according to yet another embodiment of the invention.

In FIG. 5, a tank portion 2 and an end plate 3, both having a common radius of curvature, are joined together to form a header pipe 9 having a substantially elliptical cross section. .The joint edges 3*a* of the end plate 3 are joined to the joint edges 2*a* of the tank portion 2 such that the outside surfaces of the joint edges 3*a*overlap on the inside surfaces of the joint edges 2*a* in common planes. More specifically, the joint edge 2*a* of the tank portion 2 first extends outwardly and then downwardly to form an inner step 10 against which the tip of the joint edge 3*a* is to abut.

In this structure, the joint edges of both the components are joined together in a common plane, and the tank portion has the steps against which the tips of the joint edges of the end plate abut so that it is possible to provide the reliable positioning of the end plate both circumferentially and in the joining direction, thus improving the efficiency of installation. The reliable positioning assures a uniform cross-section of header pipes, which in turn assures the reliable installation of partition plates and covers.

The flat tubes are joined to the header pipes such that the opposite ends of each flat tube are brought so closely to the joint edges that there is only a minimum clearance that is able to prevent the brazing material from entering the flat tube.

Since the ends of the flat tubes are brought so closely to the joint edges, it is possible to minimize the tank size. In addition, there is a minimum clearance between the joint edges 2*a* and 3*a* and the ends of flat tubes ,so that no brazing material flows into the flat tubes by the brazing material but also poor brazing because of a lack of the-brazing material.

Figure 6:
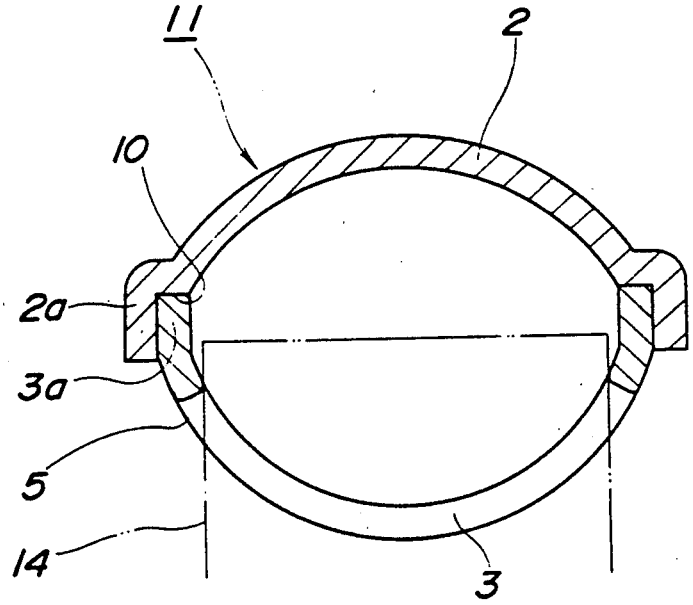
FIG. 6 is a cross sectional view of a header pipe according to still another embodiment of the invention.
Figure 7:
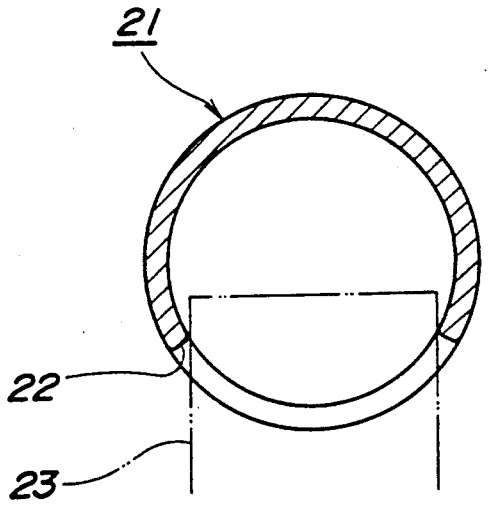
FIG. 7 PRIOR ART
FIGS. 7 and 8 are cross sectional views of header pipes according to the prior art.
Figure 8:
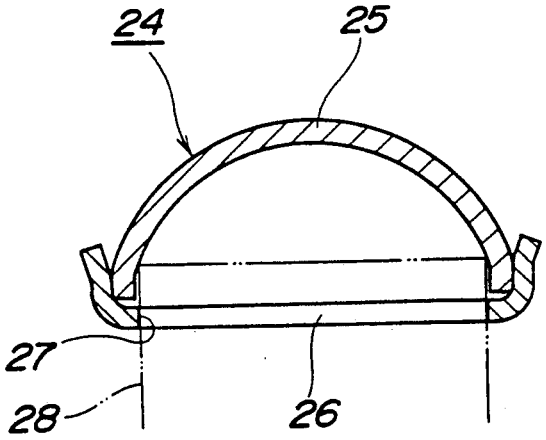
FIG. 8 PRIOR ART

In FIG. 6, similarly to the FIG. 5 embodiment, a tank portion 2 and an end plate 3 are formed and joined so as to form a header pipe 11 having a substantially elliptical cross section. However, the radius of curvature of the end plate 3 is made smaller than that of the tank portion 2.

Since the radius of curvature of the end plate 3 is smaller than that of the tank portion 2, the resistance of the end plate to the coolant pressure is improved.

The flat tubes are joined to the header pipes such that the opposite ends of each flat tube are brought so closely to the joint edges that there is only a minimum clearance that is able to prevent the brazing material from entering the flat tube.

Since the ends of the flat tubes are brought so closely to the joint edges, it is possible to minimize the tank size. In addition, there is a minimum clearance between the joint edges 2*a* and 3*a* and the ends of flat tubes so that no brazing material flows into the flat tubes by the brazing material but also poor brazing because of a lack of the brazing material.

In the above embodiments, the wall thickness of the tank portion and the end plate are equal, but it is possible to make the wall thickness of the end plate greater than that of the tank portion so as to improve the pressure resistance of the end plate. For example, the wall thicknesses of the tank portion and the end plate are 1.3 mm and 1.6 mm respectively.

We claim:

1. A condenser for use in an automobile air conditioner, which comprises:
   - a pair of header pipes each consisting of a tank portion and an end plate;
   - a plurality of parallel flat tubes extending between said header pipes for supporting coolant flows;
   - said end plates being continuously outwardly curved and joined to said tank portions such that inside surfaces of opposite joint edges of said tank portions are overlapped on outside surfaces of opposite joint edges of said end plates, whereby said tank portions reinforce said end plates to
   - said flat tubes being brazed to said header pipes such that opposite ends of each flat tube are brought so closely to said joint edges that there is only a minimum clearance that is able to prevent brazing material from entering said flat tube, whereby said tank portion is minimized.

2. The condenser of claim 1, wherein said header pipes have an oval cross-section.

3. The condenser of claim 1, wherein said end plate have a radius of curvature which is smaller than that of said tank portion.

* * * * *